US006290901B1

(12) United States Patent
Laubach

(10) Patent No.: US 6,290,901 B1
(45) Date of Patent: Sep. 18, 2001

(54) CONVERTER

(75) Inventor: Winfried Laubach, Oberhausen (DE)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 09/595,057

(22) Filed: Jun. 16, 2000

(30) Foreign Application Priority Data

Jun. 19, 1999 (DE) ..... 199 28 195

(51) Int. Cl.[7] ..... C21C 5/50
(52) U.S. Cl. ..... 266/246; 266/245
(58) Field of Search ..... 266/244, 245, 266/246

(56) References Cited

U.S. PATENT DOCUMENTS 4,281,823 * 8/1981 Enker et al. ..... 266/246
4,700,929 * 10/1987 Langlitz et al. ..... 266/246
4,946,141 * 8/1990 Vatant ..... 266/246

FOREIGN PATENT DOCUMENTS

1903685 * 2/1971 (DE) .
0040112 * 11/1981 (EP) ..... 266/246

* cited by examiner

*Primary Examiner*—Scott Kastler
(74) *Attorney, Agent, or Firm*—Sidley Austin Brown & Wood, LLP

(57) ABSTRACT

A converter including a tiltable body, a mantle ring spaced from the converter body, supportable in support lugs and having a rectangular cross-section with upper and lower flanges, and lamella suspensions and body guides for connecting the mantle ring with the converter body, with the lamella suspension including a lamella pair having one of its opposite ends releasably secured to a first attachment bracket connected to the lower flange of the mantle ring, and having another of its opposite ends releasably secured to the second attachment bracket connected with the converter body, and with the body guide including two walls secured to the mantle ring, and a guide element displaceable backlash-free between the two guide walls in a circumferential direction and releasably connected to a third attachment bracket secured to the converter body.

5 Claims, 4 Drawing Sheets

CONVERTER

BACKGROUND OF THE INVENTION

1. Field of the Invention

The present invention relates to a converter, in particular for refining pig iron and including a tiltable body, a mantle ring spaced from the converter body and supportable in support lugs, with the mantle ring having a rectangular cross-section with upper and lower flanges; the converter further including lamella suspensions and body guides for connecting the mantle ring with the converter body, with the lamella suspension including a lamella pair having one of it opposite ends secured to a first attachment bracket connected to the lower flange of the mantle ring, and having another of its opposite ends secured to the second attachment bracket connected with the converter body, and with the body guide including two guide walls secured to the mantle ring, and a guide element displaceable backlash-free between the two guide walls in a circumferential direction and connected to a third attachment bracket secured to the converter body.

2. Description of the Prior Art

A converter of the above-described type is disclosed in German Patent No. 1,903,685. The known converter proved itself as it permits radial and axial expansion of the converter body with respect to the mantle ring, and the body is reliably supported in the absence of a load.

Usually, the attachment brackets are welded to the mantle ring or the converter body, without a possibility of separation from the mantle ring or the converter body. In the known converter, the lamella suspensions can be damaged and even completely destroyed by spilled-over slag or, with a damaged jacket of the converter body, by spilled-over steel, or by caking falling out of the exhaust gas stack. The repair or restoration can be effected only upon the mechanical separation of the damaged units and replacing them with new ones.

Accordingly, an object of the present invention is to provide a converter of the above-described type the separate parts of which can be replaced by simple means.

SUMMARY OF THE INVENTION

This and other objects of the present invention, which will become apparent hereinafter, are achieved by forming releasable connections between the lamella pairs and the first and second attachment brackets and between the guide elements and the third attachment brackets. This permits to replace the guide elements and the lamella pairs without undertaking an expensive mechanical separation. This substantially reduces the time needed for repair and substantially facilitates assembly of the converter body.

According to an advantageous embodiment of the present invention, the releasable connection of the lamella pair with the first and second attachment brackets and of the guide element with the third attachment bracket is formed as force-and form locking clamp connection. The connection represents a flange-type connection between the brackets and the guide element or the lamella pair, with the load being transmitted by an intermediate conical clamp member which is secured by a screw. The deformation, which is caused by a thermal load, reinforces the clamping action of the flange portions.

Advantageously, the clamp connection includes a screw ferrule and a lock ring the associated clamping surfaces of which are connected by the conical clamp member secured with a tightening screw. Because the screw itself transmits only small clamping forces, a simple loosening of the clamp connection and, therefore, an easy replacement of damaged elements is possible, without the previously necessary expensive mechanical separation.

Because the second and third attachment brackets have a tubular shape and their diameter coincides with the diameter of the lock ring, the force transmission to the converter body or the mantle ring is improved. As a result stress concentration and, thereby, the danger of the formation of fissures, which were inevitably produced in comer regions of the previously used rectangular and box-shaped attachment brackets, is prevented to a most possible extent.

According to a further advantageous embodiment of the present invention, at least the first attachment bracket is fixedly connected with either the lock ring or with the screw ferrule. In both cases, the fixing tightening screws are easily accessible which facilitate the replacement of the lamella pair.

A certain advantage is achieved when the clamp connection of the first attachment bracket extends parallel to the lamella pair or the lower flange of the mantle ring. The advantage of the arrangement of the clamp connection parallel to the lamella pair consists in that the inner diameter of the mantle ring for dismounting of the converter body is smaller than with the alternative arrangement of the clamp connection when it extends parallel to the lower flange of the mantle ring. The advantage of the arrangement of the clamp connection parallel to the lower flange of the mantle ring consists in that it provided favorable conditions for transmission of forces from the lamella pair to the mantle ring.

It is important for the ease of the disassembly of the converter body when its diameter, together with the size of the second attachment bracket and its lock ring, are within the inner diameter of the mantle ring.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
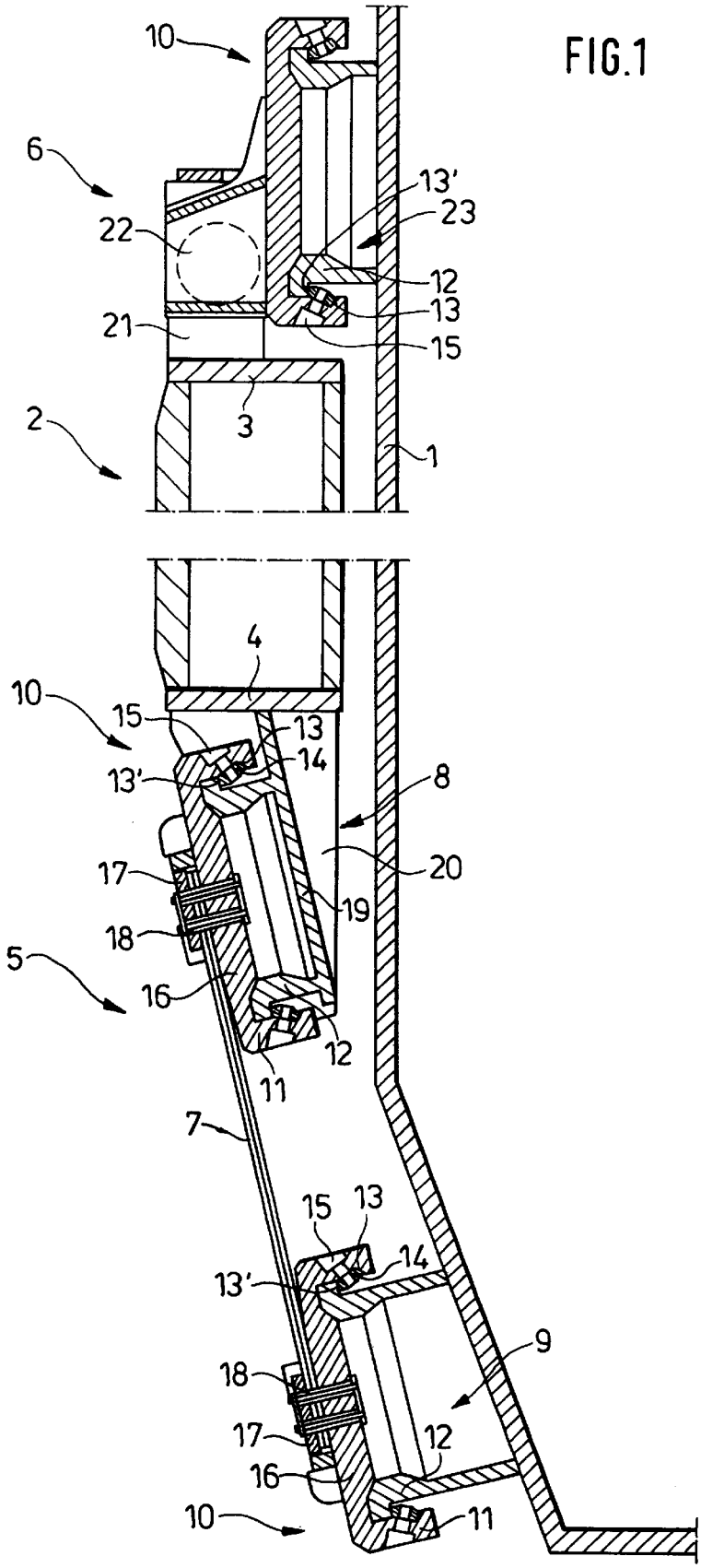
FIG. 1 a cross-sectional view of a body of a converter according to the present invention and a mantle ring connected with each other by body guides and lamella suspensions.

FIG. 1 shows a cross-sectional view of a portion of a tiltable converter body 1 with a mantle ring 2 which surrounds the body 1 and is spaced therefrom and which is adapted to pivot about support lugs (not shown). The mantle ring 2 has a rectangular cross-section with an upper flange 3 and a lower flange 4. The mantle ring 2 is connected with the converter body 1 by a total of eight lamella suspensions 5 which form four packets arranged in respective segment sections of the support lugs.

The lamella suspensions 5 serve for receiving the weight of the converter body 1 in its transverse and vertical positions, whereas the body guides 6 transmit fractions of the support forces in the converter body tilted position. Both the lamella suspensions 5 and the body guides 6 insure, in each position, an unhindered thermal expansion of the converter body in both axial and radial direction.

The lamella suspension 5 is formed of a lamella pair 7 which is connected by a first attachment bracket 8 with the lower flange 4 of the mantle ring 2 and by a second attachment bracket 9 with the converter body 1. Clamp connections 10 are arranged between the first and second attachment brackets 8 and 9 and both ends of the lamella pair 7. The clamp connection 10 consists of a screw ferrule 11 and a lock ring 12 the associated clamping surfaces 13, 13' of which are fixed with a conical clamp member 14 and a tightening screw 15. As it follows from above, the lock ring 11 and the screw ferrule 12 are releasably connected with each other.

The screw ferrule 11 has a bottom 16 with which the ends of the lamella pair 7 are connected and screwed with an aid of shear sleeves 18. The screws serve only for holding them together, in axial direction, at the ends of the lamella pair 7, with an aid of shims 17. The shear sleeves 18 transmit the tensioning forces acting on the lamella pair 7 to the bottom 16 of the screw ferrule 11. The screws themselves do not transmit any load.

The lock rings 12 connect the adjacent, to the mantle ring 2, end of the lamella pair 7 with the first attachment bracket 8 and connect the remote, from the mantle ring 2, end of the lamella pair 7 with the second attachment bracket 9. The first attachment bracket 8 is formed of a widened bottom plate 19 fixedly connected with the lock ring 12 to the lower flange 4, with two side walls 20 secured on the bottom flange 4.

The second attachment bracket 8 is tubular and is formed as an extension of the lock ring 12. This shape, in contrast to a conventional rectangular cross-section, insures force transmission to the converter body 1 without tensioning surges. This eliminates the danger of formation of fissures in the converter body 1 in the regions of the attachment brackets 8, 9 to a most possible extent.

The body guide 6 is formed of two guide walls 21 secured to the upper flange 3, and a spaced from the upper flange 3, guide element 22. The body guide 6 connects the third attachment bracket 23 with the converter body 1. A clamp connection 10 with the screw ferrule 11 the lock ring 12 is also provided between the guide element 22 and the third attachment bracket 23. The bottom 16 of the screw ferrule 11, the guide element 22, the lock ring 12, and the attachment bracket 23, which has a tubular shape and forms an extension of the lock ring 12, are all fixedly connected with each other.

Contrary to this, the screw ferrule 11 and the lock ring 12 are releasably connected with each other by the conical clamp member 14 and the tightening screw 15.

The provision of the clamp connections 10 on all three attachment brackets 8, 9 and 23 permits to easily replace the lamella suspension 5 and the body guide 6 without a need in mechanical separation.

Figure 2:
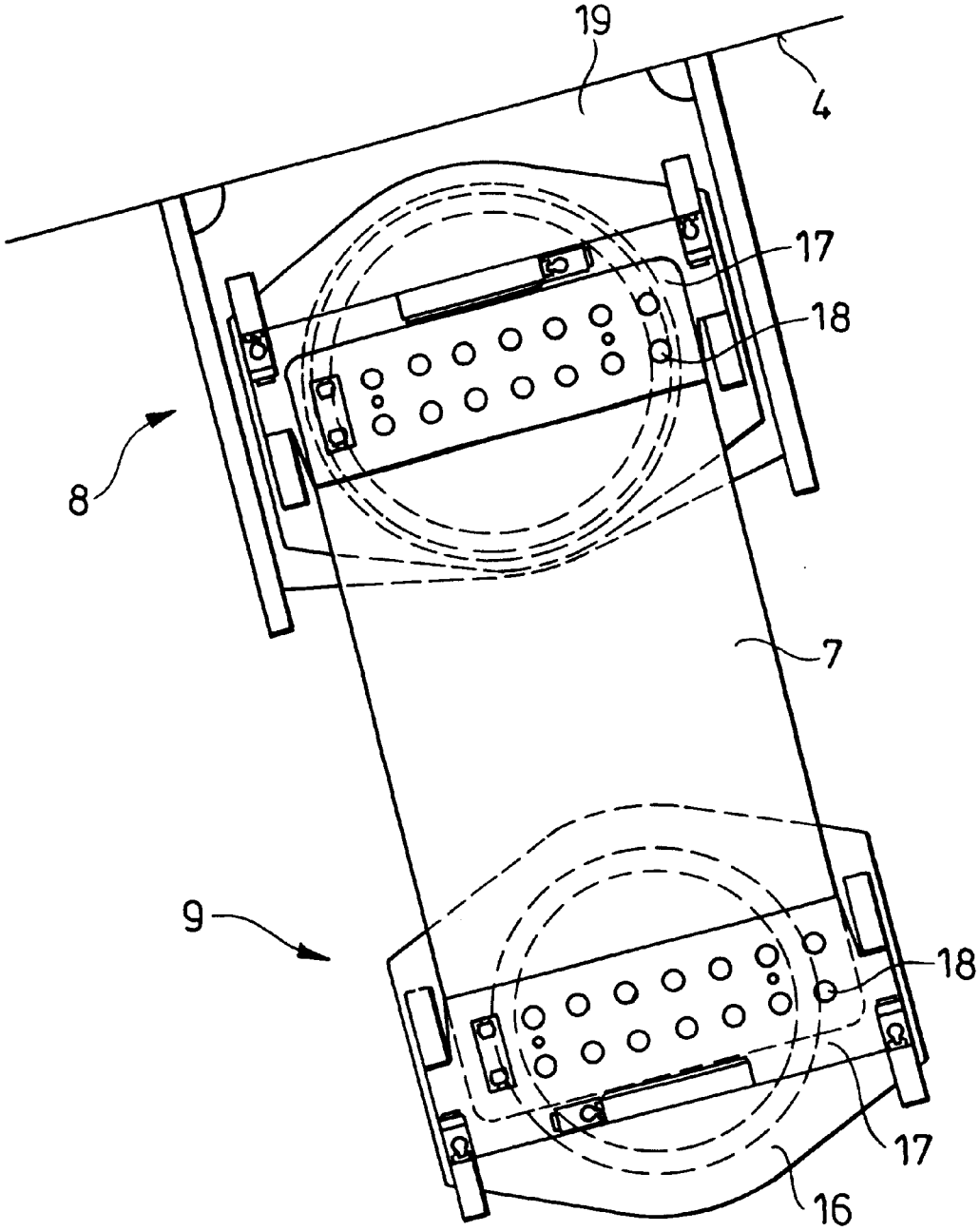
FIG. 2 a plan view of one of the lamella suspensions.

FIG. 2, as discussed above, shows a plan view of the lamella suspension 5 with the lamella pair 7, the shims 17 of which are provided with bores for shear sleeves 18, the widen bottom plate 19, and the side walls 20 of the first attachment bracket 8 being secured to the lower flange 4 of the mantle ring 2. The second attachment bracket 9 and the bottom 16 of the screw ferrule 11 can also be seen.

Figure 3:
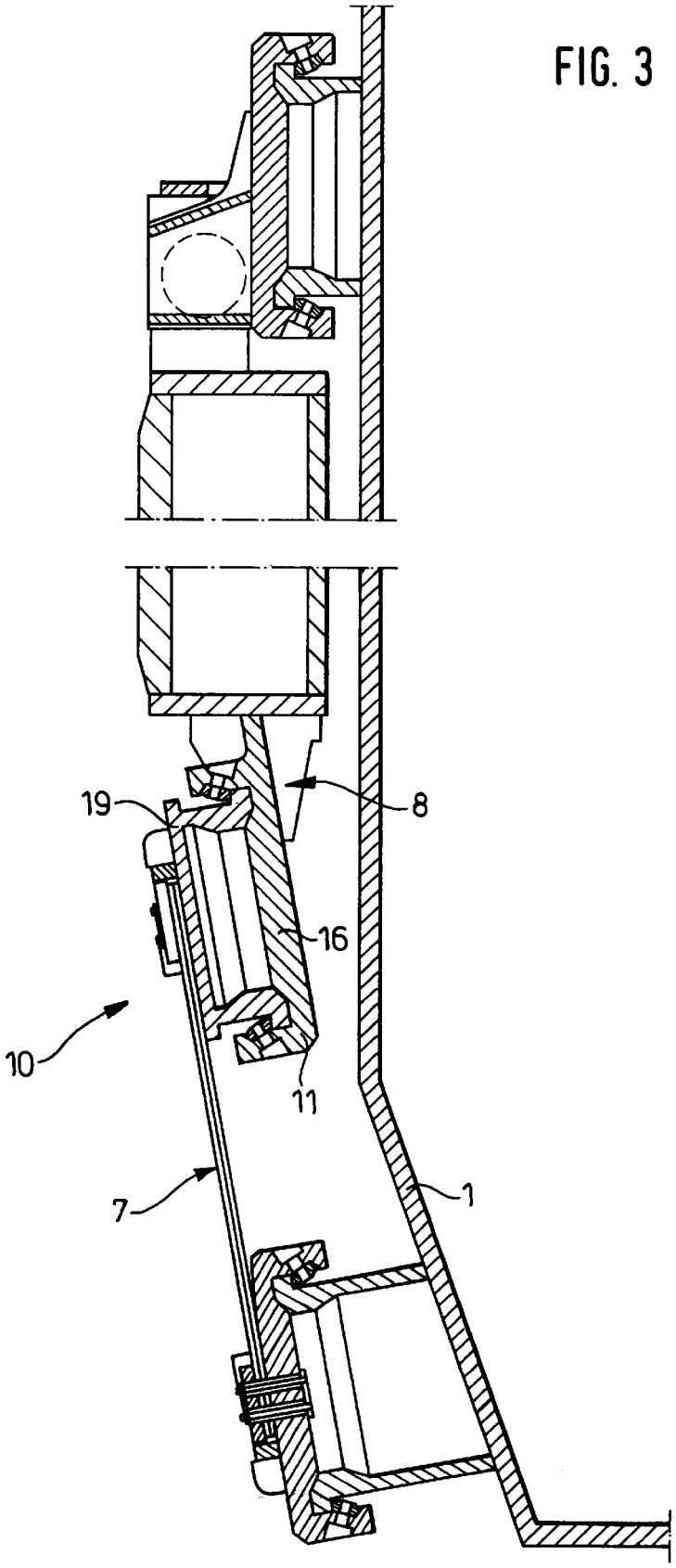
FIG. 3 a cross-sectional view of the converter body and the mantle ring similar to that of FIG. 1, but with a lock ring and screw ferrule at the first attachment bracket.
Figure 4:
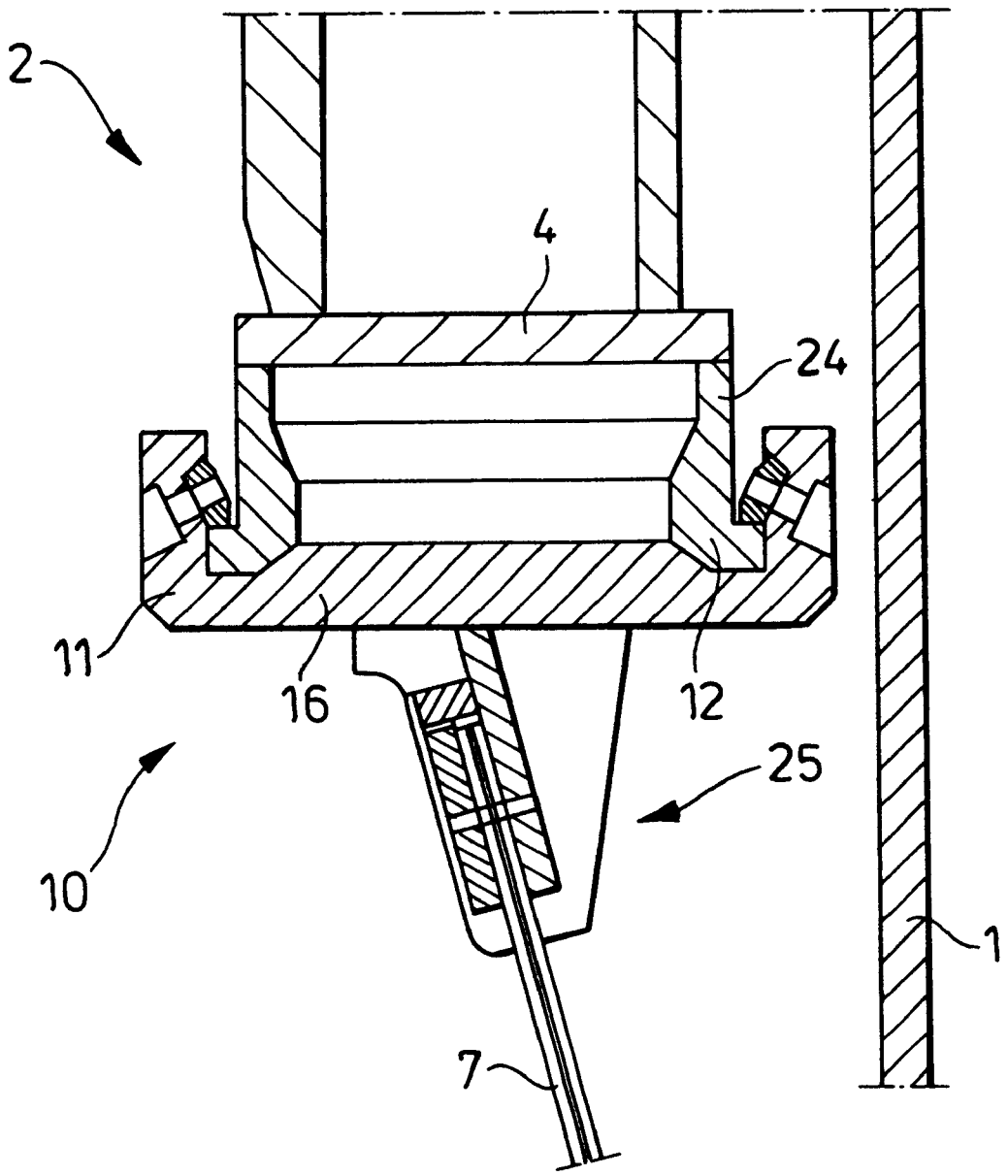
FIG. 4 a cross-sectional view showing a detail of the converter body shown in FIG. 1, wherein the clamp connection of the first attachment bracket is arranged parallel to the bottom flange.

FIGS. 3–4 show alternative embodiments of the clamp connection 10 of the first attachment bracket 8. FIG. 3 shows a reversed arrangement of the clamp connection 10. The screw ferrule 11 is secured with its correspondingly adapted bottom 16 to the first attachment bracket 8. The lock ring 12 is secured with its widen bottom plate 19 to the end of the lamella pair 7 adjacent to the mantle ring 2. This arrangement likewise insures the release of the clamp connection 10, and it also insures a favorable accessibility of the fixing screws of the upper lock element.

FIG. 4 shows the clamp connection 10 in a position in which it is arranged parallel to the lower flange 4. The lock ring 12 has a tubular extension 24 connected with the lower flange 4. In contrast to the position of the connection 10 in which it is parallel to the lanella pair 7 (FIGS. 1–3), here also, like with second and third tubular attachment brackets 9 and 23, the force is transmitted to the lower flange 4 of the mantle ring 2 without tensioning surges. A bracket 25, which is secured to the bottom 16 of the screw ferrule 11, is designed for supporting the side end of the lamella pair 7. The lamellas of the lamella pair 7 are slightly spaced from each other. This prevents wear of the lamellas which may be caused by their relative movement resulting from their deformation due to their expansion. In addition, the clearance between the lamellas insures an unhindered freedom of movement upon application of a load thereto.

The clamp connections 10, which are provided on the attachment brackets 8, 9, and 23 insure a simple replacement of separate lamella suspensions 5 and body guides 6 and, also, lifting of the converter body 1 without a need in mechanical separation.

Though the present invention was shown and described with references to the preferred embodiments, such are merely illustrative of the present invention and are not to be construed as limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A converter, comprising a tiltable body; a mantle ring spaced from the converter body and supportable in support lug means, the mantle ring having a rectangular cross-section with upper and lower flanges; and lamella suspension means and body guide means for connecting the mantle ring with the converter body, wherein the lamella suspension means comprises a lamella suspension formed as a lamella pair having one of its opposite ends secured to a first attachment bracket connected to the lower flange of the mantle ring, and having another of its opposite ends secured to the second attachment bracket connected with the converter body, wherein the body guide means comprises two guide walls secured to the upper flange of the mantle ring, and a guide element displaceable backlash-free between the two guide walls in a circumferential direction and connected to a third attachment bracket secured to the converter body, and wherein the converter further comprises means for releasably connecting the opposite ends of the lamella pair to the first and second attachment bracket and for releasably connecting the guide element to the third attachment bracket, the releasably connecting means comprising three force- and form-locking clamp connections, each of the clamp connections having a screw ferrule and a lock ring having associated clamp surfaces connectable by a conical clamp member and a tightening screw.

2. A converter as set forth in claim 1, wherein at least the second and third attachment brackets are formed as tabular elements a diameter of which coincide with the lock ring.

3. A converter as set for the in claim 2, wherein at least the first attachment bracket is fixedly connected with one of the lock ring and the screw ferrule.

4. A converter as set forth in claim 3, wherein the clamp connection of the first attachment bracket is arranged parallel to one of the lamella pair and the lower flange of the mantle ring.

5. A converter as set forth in claim 4, wherein the converter body has a diameter which, together with the second attachment bracket and the lock ring of the clamp connection of the second attachment bracket, remains within an inner diameter of the mantle ring.

* * * * *